US010385282B2

(12) United States Patent
Cho et al.

(10) Patent No.: US 10,385,282 B2
(45) Date of Patent: Aug. 20, 2019

(54) METHOD AND SYSTEM FOR UPGRADING AND SEPARATING HYDROCARBON OILS

(71) Applicant: KOREA INSTITUTE OF ENERGY RESEARCH, Daejeon (KR)

(72) Inventors: Dong Woo Cho, Daejeon (KR); Kang Hee Cho, Daejeon (KR); Jong Nam Kim, Daejeon (KR); Bharat S. Rana, Daejeon (KR); Cheol Hyun Kim, Gyeonggi-do (KR); Joon Ho Ko, Gyeonggi-do (KR); Hee Tae Beum, Daejeon (KR)

(73) Assignee: Korea Institute of Energy Research, Daejeon (KR)

( * ) Notice: Subject to any disclaimer, the term of this patent is extended or adjusted under 35 U.S.C. 154(b) by 50 days.

(21) Appl. No.: 15/614,055

(22) Filed: Jun. 5, 2017

(65) Prior Publication Data

US 2018/0134971 A1 May 17, 2018

(30) Foreign Application Priority Data

Nov. 14, 2016 (KR) ..... 10-2016-0150860

(51) Int. Cl.
*C10G 45/08* (2006.01)
*C10G 7/00* (2006.01)

(52) U.S. Cl.
CPC ..... *C10G 45/08* (2013.01); *C10G 7/00* (2013.01); *C10G 2300/4081* (2013.01)

(58) Field of Classification Search
CPC ... C10G 45/08; C10G 7/00; C10G 2300/4081
See application file for complete search history.

(56) References Cited

U.S. PATENT DOCUMENTS 4,087,354 A * 5/1978 Hessler ..... C10G 7/00 208/251 R
4,673,488 A 6/1987 Turner et al.
5,082,551 A * 1/1992 Reynolds ..... C10G 49/22 208/100
5,871,636 A 2/1999 Trachte et al.
5,910,242 A 6/1999 Halbert et al.
(Continued)

FOREIGN PATENT DOCUMENTS

EP 2684938 A2 1/2014
JP 2011173987 A 9/2011
(Continued)

OTHER PUBLICATIONS

Structural analysis of highly porous γ-Al2O3, Ulrich Hausserrnann et al, Journal of Solid State Chemistry 217 (2014) 1-8 (Year: 2014).*

*Primary Examiner* — Randy Boyer
*Assistant Examiner* — Juan C Valencia
(74) *Attorney, Agent, or Firm* — Sandberg Phoenix & von Gontard PC

(57) ABSTRACT

A method and system for upgrading and separating hydrocarbon are provided. The method may include preheating hydrocarbon containing impurities, removing non-hydrocarbon impurities from the hydrocarbon using a hydroprocessing catalyst and hydrogen gas after inserting the preheated hydrocarbon into a reactor, and separating gas from liquid.

13 Claims, 5 Drawing Sheets

(56) References Cited

U.S. PATENT DOCUMENTS

| | | | | |
|---|---|---|---|---|
| 5,928,501 | A * | 7/1999 | Sudhakar | C10G 45/16<br>208/114 |
| 8,815,085 | B2 | 8/2014 | Husain et al. | |
| 9,127,215 | B2 * | 9/2015 | Choi | B01J 23/883 |
| 2013/0289328 | A1 | 10/2013 | Choi et al. | |

FOREIGN PATENT DOCUMENTS

| | | | |
|---|---|---|---|
| KR | 20120081032 | A | 7/2012 |
| KR | 20160103991 | A | 9/2016 |
| WO | 2007117919 | A2 | 10/2007 |
| WO | 2015077558 | A1 | 5/2015 |

* cited by examiner

METHOD AND SYSTEM FOR UPGRADING AND SEPARATING HYDROCARBON OILS

CROSS-REFERENCE TO RELATED APPLICATION

This application claims the benefit of Korean Patent Application No. 10-2016-0150860, filed on Nov. 14, 2016, in the Korean Intellectual Property Office, the disclosure of which is incorporated herein by reference.

BACKGROUND

1. Field of the Invention

At least one example embodiment relates to a method and system for upgrading and separating hydrocarbon.

2. Description of the Related Art

Due to a limitation on a worldwide production of light crude oil, a production of heavy crude oil relatively inexpensive in comparison to the light crude oil is increasing. The heavy crude oil may contain a large amount of impurities, and may have a bad influence on an efficiency and a process stability when the heavy crude oil that is not separately processed is introduced into an existing oil refining process. Accordingly, a throughput of the heavy crude oil is extremely limited.

In an oil refining process, a small amount of heavy crude oil containing a large amount of impurities is mixed with a large amount of light crude oil having an American Petroleum Institute (API) gravity that is greater than or equal to 25 degrees or that is generally greater than or equal to 30 degrees, and a mixture is introduced into an oil refining system including a separator and a reactor. However, a throughput and a range of heavy crude oil that is available based on an influence of a subsequent process may be limited.

Impurities (for example, sulfur (S), nickel (Ni), vanadium (V), asphaltene and an organic acid) contained in heavy crude oil may be chemically bonded to hydrocarbon. To remove the impurities, a reaction process using hydrogen may be performed. Since an amount of hydrogen increases in comparison to an amount of introduced heavy crude oil, it is inevitable to obtain unreacted hydrogen. When the unreacted hydrogen is introduced into a separation process, in particular, into a crude distillation unit such as an atmospheric distillation apparatus, a gas flow may drastically increase, which may cause flooding. To prevent the flooding, a size of an atmospheric distillation apparatus may need to increase.

To recycle the unreacted hydrogen, when a gas-liquid separator is installed, crude oil vapor may flow in the air along with the gas flow. Also, a feedstream may not be inserted directly into an atmospheric distillation column due to a high pressure reaction, and an appropriate decompression process may be required. For a reaction, the feedstream may be warmed to a temperature close to a temperature measured when the feedstream is inserted into the atmospheric distillation column by passing through a fired heater. Thus, a large amount of energy may be consumed and energy recycling may be required.

To introduce and process relatively inexpensive heavy crude oil, there is a desire for improvement of a process of upgrading heavy crude oil.

SUMMARY

The system and method disclosed herein solves the foregoing problems, and, in an aspect, provides a method of upgrading and separating hydrocarbon which may enhance a removal rate of impurities from a hydrocarbon oil fraction through a hydroprocessing process and may stably remove impurities and unreacted hydrogen generated in the hydroprocessing process by a process of reducing a pressure and a temperature in stages.

Another aspect provides a hydrocarbon oil refining method that may reduce an occurrence of flooding due to impurities (for example, gas such as sulfur compounds, or hydrogen sulfide ($H_2S$)) and unreacted hydrogen in an atmospheric distillation apparatus, by using a method of upgrading hydrocarbon, and that may optimize an energy efficiency.

Still another aspect provides a system for upgrading and separating hydrocarbon using the method of upgrading and separating hydrocarbon.

Yet another aspect provides an oil refining system using a hydrocarbon oil refining method.

However, the problems to be solved in the present disclosure are not limited to the foregoing problems, and other problems not mentioned herein would be clearly understood by one of ordinary skill in the art from the following description.

According to an aspect, there is provided a method of upgrading and separating hydrocarbon, including preheating hydrocarbon containing impurities, removing non-hydrocarbon impurities from the hydrocarbon using a hydroprocessing catalyst and hydrogen gas after inserting the preheated hydrocarbon into a reactor, and separating gas from liquid, wherein the separating is performed in a continuous process by a multi-stage gas-liquid separator at the same temperature or different temperatures and at the same pressure or different pressures.

In the removing, a volume ratio of the hydrocarbon:the hydrogen gas may range from 1:5 to 1:100.

The hydroprocessing catalyst may include a support including at least one of alumina, aluminosilicate, zeolite, silica, titanium oxide and zirconium oxide, and a active catalyst component including at least one of nickel (Ni), cobalt (Co), tungsten (W), molybdenum (Mo), platinum (Pt), palladium (Pd), ruthenium (Ru), rhodium (Rh), phosphorus (P), carbon (C) and nitrogen (N) that are supported on the support, or oxides and alloys thereof.

The hydroprocessing catalyst may include at least one of CoO, $MoO_3/\gamma—Al_2O_3$; CoO, $WO_3/\gamma—Al_2O_3$; CoO, $MoO_3$/Meso-Y Zeolite; P, CoO, $MoO_3/\gamma—Al_2O_3$; P, CoO, $WO_3/\gamma—Al_2O_3$; NiO, $MoO_3/\gamma—Al_2O_3$; P, NiO, $MoO_3/\gamma—Al_2O_3$; P, NiO, $WO_3/\gamma—Al_2O_3$; P, NiO, $WO_3$, $MoO_3/\gamma—Al_2O_3$; P, CoO, $WO_3$, $MoO_3/\gamma—Al_2O_3$; CoO, $MoO_3/SiO_2—Al_2O_3$ ($SiO_2$-5%); CoO, $MoO_3/SiO_2—Al_2O_3$($SiO_2$-20%); CoO, $MoO_3/SiO_2—Al_2O_3$($SiO_2$-40%); CoO, $MoO_3/\gamma—Al_2O_3$ (50%)+H-YZ(50%); CoO, $MoO_3$/Nano-MFI(50%)+$\gamma—Al_2O_3$(50%); CoO, $MoO_3$/ZeoliteHY(50%)+$\gamma—Al_2O_3$ (50%); CoO, $MoO_3$/Nano-MFI; P, CoO, $MoO_3/SiO_2—Al_2O_3$($SiO_2$-20%); and CoO, $MoO_3$, $P/SiO_2—Al_2O_3$($SiO_2$-40%).

The active catalyst component may be present in an amount of 1% by weight (wt %) to 30 wt % in the hydroprocessing catalyst and the hydroprocessing catalyst may be presulfided.

The removing may include removing an organic acid.

The removing may be performed under a condition of a temperature of 250° C. to 400° C., a pressure of 10 bar to 100 bar and a liquid hourly space velocity (LHSV) of 1 $h^{-1}$ to 20 $h^{-1}$.

The separating may include condensing hydrocarbon discharged from the reactor under a condition of a temperature of 40° C. or higher and a pressure of 1.2 bar or higher and separating gas from liquid by at least one multi-stage gas-liquid separator.

The method may further include removing gas. The removing of the gas may include removing hydrogen gas from the separated gas. The hydrogen gas may be reused to remove the non-hydrocarbon impurities.

According to another aspect, there is provided a hydrocarbon oil refining method including introducing hydrocarbon upgraded and separated by the method of upgrading and separating hydrocarbon into an atmospheric distillation apparatus, and performing an atmospheric distillation.

The introducing may include introducing the hydrocarbon as a side stream into the atmospheric distillation apparatus.

The introducing may include introducing a mixture of the hydrocarbon and light crude oil into the atmospheric distillation apparatus.

The light crude oil may be desalted and preheated at a temperature of 300° C. to 400° C.

According to still another aspect, there is provided a system for upgrading and separating hydrocarbon, including a heating furnace configured to preheat hydrocarbon containing impurities, a reactor configured to remove the non-hydrocarbon impurities from the hydrocarbon using a hydroprocessing catalyst and hydrogen gas, and a multi-stage gas-liquid separator configured to separate the hydrocarbon discharged from the reactor into gas and liquid, wherein the multi-stage gas-liquid separator includes at least one gas-liquid separator configured to perform a continuous process at the same temperature or different temperatures and at the same pressure or different pressures.

The system may include a multi-stage gas-liquid separator configured to condense the hydrocarbon discharged from the reactor and separate the hydrocarbon into gas and liquid.

The system may further include a gas separator configured to separate gas from the gas separated in the gas-liquid separator.

Gas separated in the gas separator may be introduced into the heating furnace, and the gas may be hydrogen gas.

According to yet another aspect, there is provided an oil refining system including a hydrocarbon upgrading/separating portion including the system, and an atmospheric distillation portion including an atmospheric distillation apparatus.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION

Figure 1:
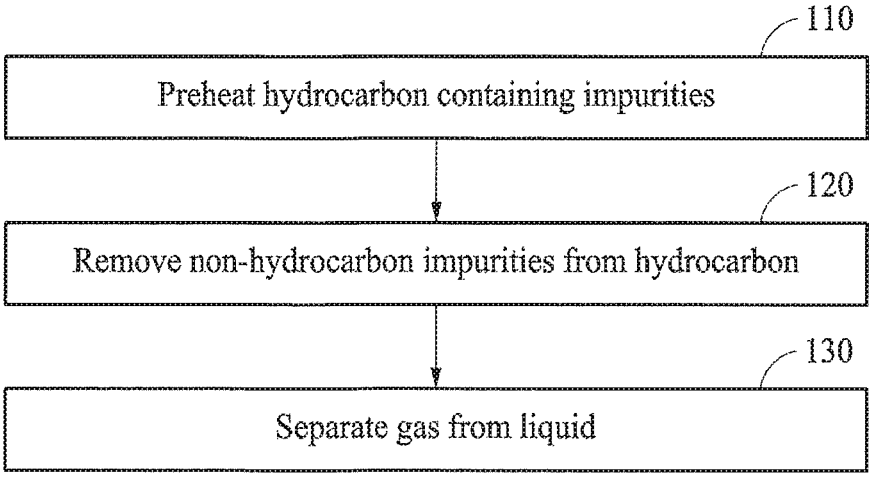
FIG. 1 is a flowchart illustrating an example of a method of upgrading and separating hydrocarbon according to an example embodiment.

Hereinafter, example embodiments of the present disclosure will be described in detail with reference to the accompanying drawings. When it is determined that a detailed description related to a related known function or configuration may make the purpose of the present disclosure unnecessarily ambiguous in describing the present disclosure, the detailed description will be omitted here. Also, terms used herein are defined to appropriately describe the example embodiments and thus may be changed depending on a user, the intent of an operator, or a custom of a field to which the present disclosure pertains. Accordingly, the terms must be defined based on the following overall description of this specification. Like reference numerals present in the drawings refer to the like elements throughout.

According to an example embodiment, a method of upgrading and separating hydrocarbon may be provided. The method may enhance a removal rate of impurities from a hydrocarbon oil fraction through a hydroprocessing process, and may effectively remove impurities and unreacted hydrogen generated in the hydroprocessing process through a process of reducing a pressure and a temperature in stages.

FIG. 1 is a flowchart illustrating an example of a method of upgrading and separating hydrocarbon according to an example embodiment. The method of FIG. 1 may include operation 110 of preheating hydrocarbon containing impurities, operation 120 of removing non-hydrocarbon impurities from the hydrocarbon, and operation 130 of separating gas from liquid.

For example, in operation 110, a hydrocarbon oil fraction containing impurities may be desalted and preheated at a temperature of 300° C. to 400° C. or a temperature of 340° C. to 370° C. Hydrocarbon containing impurities may include, for example, heavy crude oil.

In operation 120, the preheated hydrocarbon may be introduced into a reactor, a hydroprocessing catalyst and hydrogen gas may be inserted, and non-hydrocarbon impurities may be removed from the hydrogen, for example, a hydrocarbon oil fraction containing impurities.

The non-hydrocarbon impurities may include, for example, an organic acid, sulfur (S), nitrogen (N), metals (for example, nickel (Ni), vanadium (V), and the like), and the like. The organic acid may be a material containing a carboxyl group (—COOH) in a basic structure of hydrocarbon such as cyclopentyl or cyclohexyl, and may include, for example, a naphthenic acid, and the like.

In operation 120, a volume ratio of the hydrocarbon:the hydrogen gas may range from 1:5 to 1:100, range from 1:20 to 1:100, range from 1:30 to 1:80, or range from 1:30 to 1:60. When the volume ratio is within the above ranges, a removal rate of the non-hydrocarbon impurities may be enhanced.

The hydroprocessing catalyst may include, for example, a support including at least one of alumina, aluminosilicate, zeolite, silica, titanium oxide and zirconium oxide, and a active catalyst component including at least one metal supported on the support among Ni, cobalt (Co), tungsten (W), molybdenum (Mo), platinum (Pt), palladium (Pd), ruthenium (Ru), rhodium (Rh), phosphorus (P), carbon (C) and nitrogen (N), or oxides and alloys thereof.

The support may include, for example, $\gamma$—$Al_2O_3$, $SiO_2$, $SiO_2$—$Al_2O_3$($SiO_2$-5%), $SiO_2$—$Al_2O_3$($SiO_2$-20%), $SiO_2$—$Al_2O_3$($SiO_2$-40%), HYZeolite (H-YZ), MFIZeolite, HYZolite+$\gamma$—$Al_2O_3$, MFIzeolite+$\gamma$—$Al_2O_3$, MFIzeoliteNanosheet, and the like.

The metal supported on the support may include, for example, Pt, Pd, Ru, Rh, CoO—$MoO_3$, P—CoO—$MoO_3$, NiO—$MoO_3$, CoO—$WO_3$, P—CoO—$WO_3$, NiO—$WO_3$, P—NiO—$WO_3$, CoO—NiO—$MoO_3$, CoO—NiO—$WO_3$, Co—N, Ni—N, Co—Ni—N, Co—P, Ni—P, Co—Ni—P, Co—C, Ni—C, Co—Ni—C, Mo—N, Mo—P, Mo—C, and the like.

The hydroprocessing catalyst may include, for example, at least one of CoO, $MoO_3$/$\gamma$—$Al_2O_3$; CoO, $WO_3$/$\gamma$—$Al_2O_3$; CoO, $MoO_3$/Meso-Y Zeolite; P, CoO, $MoO_3$/$\gamma$—$Al_2O_3$; P, CoO, $WO_3$/$\gamma$—$Al_2O_3$; NiO, $MoO_3$/$\gamma$—$Al_2O_3$; P, NiO, $MoO_3$/$\gamma$—$Al_2O_3$; P, NiO, $WO_3$/$\gamma$—$Al_2O_3$; P, NiO, $WO_3$, $MoO_3$/$\gamma$—$Al_2O_3$; P, CoO, $WO_3$, $MoO_3$/$\gamma$—$Al_2O_3$; CoO, $MoO_3$/$SiO_2$—$Al_2O_3$($SiO_2$-5%); CoO, $MoO_3$/$SiO_2$—$Al_2O_3$ ($SiO_2$-20%); CoO, $MoO_3$/$SiO_2$—$Al_2O_3$($SiO_2$-40%); CoO, $MoO_3$/$\gamma$—$Al_2O_3$(50%)+H-YZ(50%); CoO, $MoO_3$/Nano-MFI(50%)+$\gamma$—$Al_2O_3$(50%); CoO, $MoO_3$/ZeoliteHY (50%)+$\gamma$—$Al_2O_3$(50%); CoO, $MoO_3$/Nano-MFI; P, CoO, $MoO_3$/$SiO_2$—$Al_2O_3$($SiO_2$-20%); and CoO, $MoO_3$, P/$SiO_2$—$Al_2O_3$($SiO_2$-40%).

For example, the active catalyst component may be present in an amount of 1% by weight (wt %) to 30 wt %, an amount of 1 wt % to 15 wt %, or an amount of 1 wt % to 5 wt %, in the hydroprocessing catalyst. When the amount of the active catalyst component is within the above ranges, a catalytic activity may be optimized to enhance a removal rate of an organic acid.

The hydroprocessing catalyst may include, for example, 4.5 wt % CoO, 14.5 wt % $MoO_3$/$\gamma$—$Al_2O_3$; 4.5 wt % CoO, 14.5 wt % $WO_3$/$\gamma$—$Al_2O_3$; 4.5 wt % CoO, 14.5 wt % $MoO_3$/MesoHY-Zeolite; 6.8 wt % CoO, 21.9 wt % $MoO_3$/$\gamma$—$Al_2O_3$; 2 wt % P, 6.8 wt % CoO, 21.9 wt % $MoO_3$/$\gamma$—$Al_2O_3$; 2 wt % P, 4.5 wt % CoO, 14.5 wt % $MoO_3$/$\gamma$—$Al_2O_3$; 2 wt % P, 4.5 wt % CoO, 14.5 wt % $WO_3$/$\gamma$—$Al_2O_3$; 4.5 wt % NiO, 14.5 wt % $MoO_3$/$\gamma$—$Al_2O_3$; 2 wt % P, 4.5 wt % NiO, 14.5 wt % $MoO_3$/$\gamma$—$Al_2O_3$; 2 wt % P, 4.5 wt % NiO, 14.5 wt % $WO_3$/$\gamma$—$Al_2O_3$; 2 wt % P, 4.5 wt % NiO, 7.5 wt % $WO_3$-7.5 wt % $MoO_3$/$\gamma$—$Al_2O_3$; 2 wt % P, 4.5 wt % CoO, 7.5 wt % $WO_3$-7.5 wt % $MoO_3$/$\gamma$—$Al_2O_3$; 2 wt % P, 4.5 wt % CoO, 14.5 wt % $MoO_3$/(Alumina Silicagel from Sorbead WS0525); 5 wt % P, 4.5 wt % CoO, 14.5 wt % $MoO_3$/$\gamma$—$Al_2O_3$; 4.5 wt % CoO, 14.5 wt % $MoO_3$/$SiO_2$—$Al_2O_3$ ($SiO_2$-5%); 4.5 wt % CoO, 14.5 wt % $MoO_3$/$SiO_2$—$Al_2O_3$ ($SiO_2$-20%); 4.5 wt % CoO, 14.5 wt % $MoO_3$/$SiO_2$—$Al_2O_3$ ($SiO_2$-40%); 4.5 wt % CoO, 14.5 wt % $MoO_3$/$\gamma$—$Al_2O_3$ (50%)+H-YZ(50%); 4.5 wt % CoO, 14.5 wt % $MoO_3$/Nano-MFI(50%)+$\gamma$—$Al_2O_3$(50%); 4.5 wt % CoO, 14.5 wt % $MoO_3$/ZeoliteHY(50%)+$\gamma$—$Al_2O_3$(50%); 4.5 wt % CoO, 14.5 wt % $MoO_3$/Nano-MFI; 1.5 wt % P, 6 wt % CoO, 30 wt % $MoO_3$/$SiO_2$—$Al_2O_3$($SiO_2$-20%); and 1.5 wt % P, 6 wt % CoO, 30 wt % $MoO_3$/$SiO_2$—$Al_2O_3$($SiO_2$-40%).

For example, the hydroprocessing catalyst may be presulfided and may be inserted. The presulfiding may be performed to add sulfur onto a surface of the hydroprocessing catalyst or to dope the surface with sulfur, and may convert an oxide into a sulfide at an active site for reactions in the hydroprocessing catalyst. A reactivity may be enhanced by the above presulfiding, and thus a removal rate of impurities, for example, an organic acid, and the like, may increase and a long term operability of a process may be enhanced.

For example, operation 120 may be performed at a reaction temperature of 250° C. to 400° C., a reaction temperature of 250° C. to 350° C., or a reaction temperature of 250° C. to 300° C. Also, operation 120 may be performed at a pressure of 10 bar to 100 bar, a pressure of 15 bar to 90 bar, or a pressure of 30 bar to 70 bar. In addition, operation 120 may be performed at a liquid hourly space velocity (LHSV) of 1 $h^{-1}$ to 20 $h^{-1}$, an LHSV of 2 $h^{-1}$ to 15 $h^{-1}$, or an LHSV of 2 $h^{-1}$ to 10 $h^{-1}$. When the reaction temperature, the pressure and the LHSV are within the above ranges, a removal rate of the non-hydrocarbon impurities may increase.

In operation 130, hydrocarbon discharged from the reactor may be separated into gas and liquid, to remove impurities, for example, unreacted hydrogen, generated in a hydroprocessing reaction in the reactor. Operation 130 may be performed through a process of reducing a pressure and a temperature in stages, and accordingly impurities may be effectively and energy efficiently removed. In addition, after hydrocarbon is upgraded and separated, flooding of the hydrocarbon in an atmospheric distillation apparatus may be prevented when the hydrocarbon is introduced into the atmospheric distillation apparatus.

Operation 130 may be performed in a continuous process with at least one stage at the same temperature or different temperatures and at the same pressure or different pressures. For example, in operation 130, the hydrocarbon discharged from the reactor may be condensed under a condition of a temperature of 40° C. or higher and a pressure of 1.2 bar or higher and may be separated into gas and liquid by at least one multi-stage gas-liquid separator. Desirably, a condition of a CDU (Crude Distillation Unit) top may include, for example, a temperature of 100° C. to 150° C. or a temperature of 100° C. to 120° C., and a pressure of 1.2 bar to 2.5 bar, a pressure of 1.2 bar to 2.0 bar, or a pressure of 1.5 bar to 2.0 bar.

For example, in operation 130, a continuous process may be performed by reducing a pressure and a temperature.

For example, liquid separated in each of the stages of operation 130 may be introduced into the atmospheric distillation apparatus, to be applicable to an oil refining process.

The method may further include operation of removing gas. In the operation of removing gas, hydrogen gas may be removed from gas separated by a last stage of operation 130. The hydrogen gas may be preheated together with the hydrocarbon in operation 110, to be reused in operation 120 or to be inserted into the reactor and reused in operation 120.

According to an example embodiment, a hydrocarbon oil refining method based on the method of upgrading and separating hydrocarbon may be provided.

Figure 2:
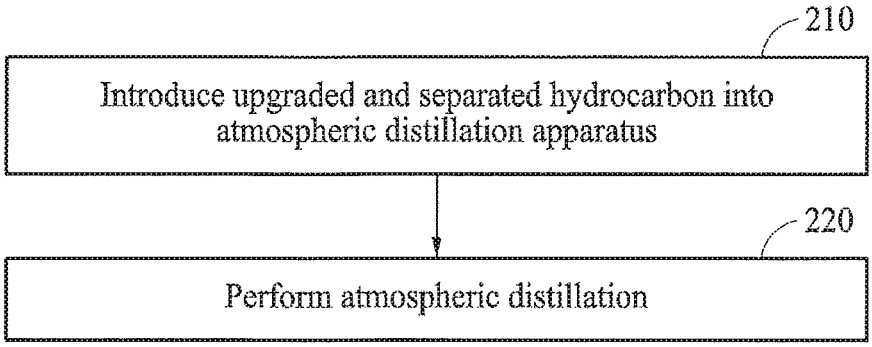
FIG. 2 is a flowchart illustrating an example of a hydrocarbon oil refining method according to an example embodiment.

FIG. 2 is a flowchart illustrating an example of a hydrocarbon oil refining method according to an example embodiment. The hydrocarbon oil refining method of FIG. 2 may include operation 210 of introducing upgraded and separated hydrocarbon into an atmospheric distillation apparatus and operation 220 of performing an atmospheric distillation.

In the hydrocarbon oil refining method, hydrocarbon, from which impurities (for example, unreacted hydrogen gas generated in a hydroprocessing reaction, and impurities in a hydrocarbon oil fraction) are effectively removed in a process of upgrading and separating hydrocarbon, may be used. Also, when the hydrocarbon is introduced into an atmospheric distillation apparatus for an oil refining process, a size of the atmospheric distillation apparatus may be minimized, and flooding in the atmospheric distillation apparatus may be prevented, and thus it is possible to enhance a stability of the oil refining process.

In operation 210, a liquid hydrocarbon feed generated by applying the method of upgrading and separating hydrocarbon may be introduced into the atmospheric distillation apparatus. The liquid hydrocarbon feed may be separated through a process of reducing a pressure and a temperature in stages, and may enhance a stability of a process in the atmospheric distillation apparatus and an energy efficiency of the oil refining process.

For example, in operation 210, the upgraded and separated liquid hydrocarbon feed may be introduced as a side stream into the atmospheric distillation apparatus. Thus, it is possible to enhance the energy efficiency of the oil refining process.

In operation 220, the liquid hydrocarbon feed may be distilled and separated in the atmospheric distillation apparatus, to generate a product.

Figure 3:
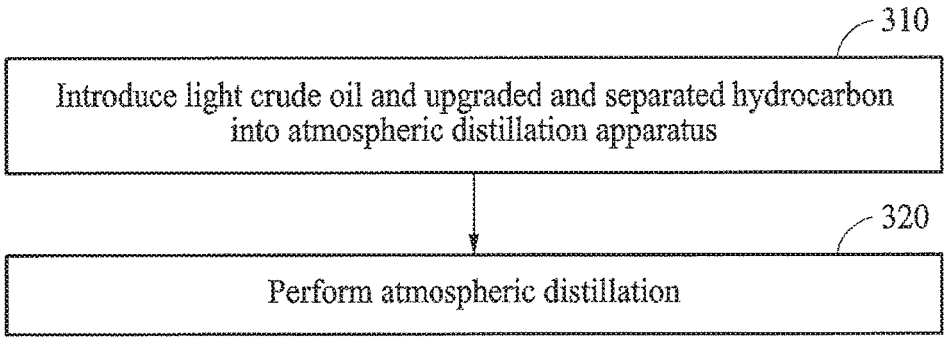
FIG. 3 is a flowchart illustrating another example of a hydrocarbon oil refining method according to an example embodiment.

FIG. 3 is a flowchart illustrating another example of a hydrocarbon oil refining method according to an example embodiment. The method of FIG. 3 may include operation 310 of introducing light crude oil and upgraded and separated hydrocarbon into an atmospheric distillation apparatus, and operation 320 of performing an atmospheric distillation. In the method of FIG. 3, the upgraded and separated hydrocarbon may be used and may be mixed with the light crude oil at a high mixing ratio in comparison to a related art, and a mixture of the hydrocarbon and the light crude oil may be applied to an oil refining process. Thus, it is possible to prevent a reduction in an efficiency and stability of a subsequent process due to impurities in the hydrocarbon.

In operation 310, a liquid hydrocarbon feed obtained by mixing the upgraded and separated hydrocarbon with the light crude oil may be introduced into the atmospheric distillation apparatus.

For example, the light crude oil may be mixed with liquid separated in at least one stage of a gas-liquid separation provided in a method of upgrading and separating hydrocarbon according to an example embodiment, and may desirably be mixed with liquid separated in a first stage of the gas-liquid separation.

For example, the light crude oil may have an American Petroleum Institute (API) gravity greater than or equal to 25 degrees, may be desalted, and may be preheated at a temperature of 300° C. to 400° C. or a temperature of 340° C. to 370° C.

The light crude oil may be mixed with the upgraded and separated hydrocarbon at a volume ratio of 1:99, and a mixture may be introduced into the atmospheric distillation apparatus.

Operation 320 may be performed in the same manner as operation 220.

According to an example embodiment, a system (hereinafter, referred to as a "hydrocarbon upgrading/separating system") for upgrading and separating hydrocarbon may be provided. A method of upgrading and separating hydrocarbon according to an example embodiment may be applied to the hydrocarbon upgrading/separating system. The hydrocarbon upgrading/separating system may effectively remove impurities from a hydrocarbon oil fraction through a hydroprocessing process, and may remove impurities, for example, unreacted hydrogen gas generated in the hydroprocessing process by a process of reducing a pressure and a temperature in stages. When the hydrocarbon upgrading/separating system is applied to an oil refining system, an energy efficiency and stability of the oil refining system may be enhanced.

Figure 4:
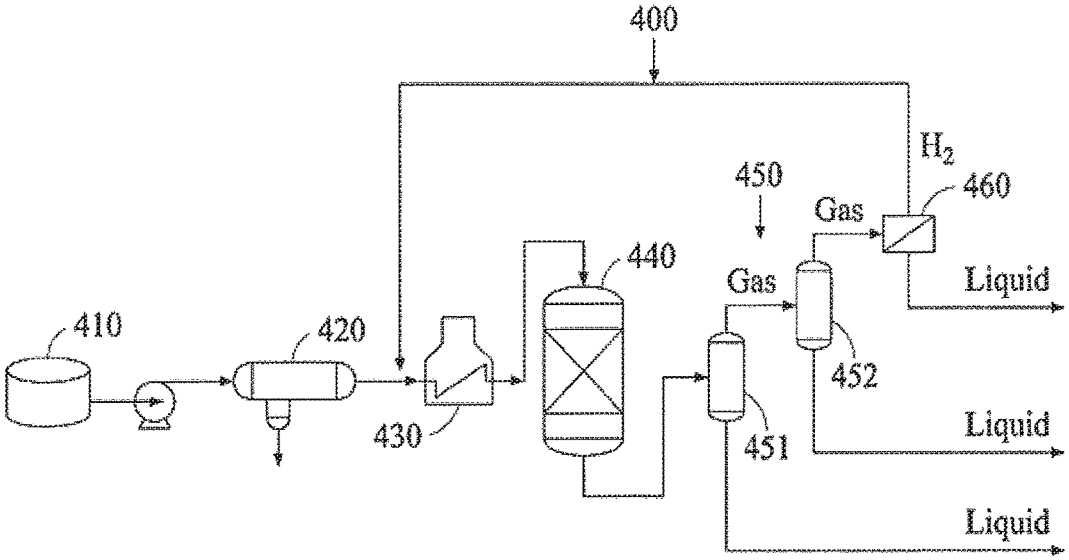
FIG. 4 is a diagram illustrating an example of a system for upgrading and separating hydrocarbon according to an example embodiment.

FIG. 4 is a diagram illustrating an example of a hydrocarbon upgrading/separating system according to an example embodiment. Referring to FIG. 4, a hydrocarbon upgrading/separating system 400 may include a hydrocarbon storage tank 410, a desalter 420, a heating furnace 430, a reactor 440 and a multi-stage gas-liquid separator 450.

The hydrocarbon storage tank 410 may store impurities-containing hydrocarbon used in an upgrading and separating process, and may include, for example, a tank to store heavy crude oil containing non-hydrocarbon impurities.

The desalter 420 may desalt the hydrocarbon transferred from the hydrocarbon storage tank 410. A temperature of the hydrocarbon passing through the desalter 420 may range from 110° C. to 150° C. or from 140° C. to 150° C.

The hydrocarbon upgrading/separating system 400 may further include a dehydrator (not shown) to remove moisture from the hydrocarbon, in addition to the desalter 420.

The heating furnace 430 may preheat the impurities-containing hydrocarbon desalted by the desalter 420, for example, at a temperature of 300° C. to 400° C. or a temperature of 340° C. to 370° C. For example, the desalter 420 may include a multi-stage heat exchanger and a heater.

In the reactor 440, the impurities-containing hydrocarbon preheated in the heating furnace 430 may be introduced, and a process of removing non-hydrocarbon impurities from the hydrocarbon using a hydroprocessing catalyst and hydrogen gas may be performed. The reactor 440 may discharge the hydrocarbon from which the non-hydrocarbon impurities are removed to the multi-stage gas-liquid separator 450.

The multi-stage gas-liquid separator 450 may separate the hydrocarbon discharged from the reactor 440 into gas and liquid, and may include at least one gas-liquid separator to perform a continuous process at the same temperature or different temperatures and at the same pressure or different pressures. For example, the multi-stage gas-liquid separator 450 may include at least two gas-liquid separators, for example, a first gas-liquid separator 451 and a second gas-liquid separator 452. The first gas-liquid separator 451 may condense the hydrocarbon discharged from the reactor 440 to separate the hydrocarbon into gas and liquid. The second gas-liquid separator 452 may condense the gas separated in the first gas-liquid separator 451 to separate the gas into gas and liquid.

Figure 5:
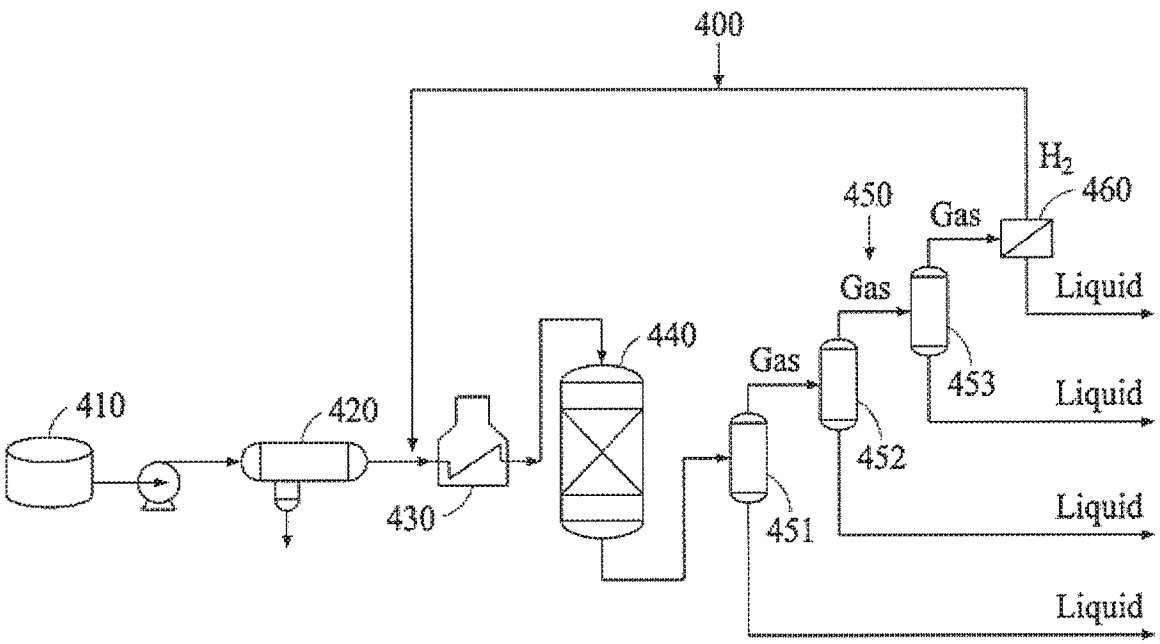
FIG. 5 is a diagram illustrating another example of a system for upgrading and separating hydrocarbon according to an example embodiment.

FIG. 5 is a diagram illustrating another example of a hydrocarbon upgrading/separating system according to an example embodiment. Referring to FIG. 5, a hydrocarbon upgrading/separating system 400 may include at least three gas-liquid separators, for example, a first gas-liquid separator 451, a second gas-liquid separator 452 and a third gas-liquid separator 453. The first gas-liquid separator 451 may condense hydrocarbon discharged from a reactor 440 to separate the hydrocarbon into gas and liquid. The second gas-liquid separator 452 may condense the gas separated in the first gas-liquid separator 451 to separate the gas into gas and liquid. The third gas-liquid separator 453 may condense the gas separated in the second gas-liquid separator 452 to separate the gas into gas and liquid.

For example, the first gas-liquid separator 451 may condense the hydrocarbon discharged from the reactor 440, to separate gas from liquid. The separated gas may flow into the second gas-liquid separator 452, and the separated liquid may flow into an atmospheric distillation apparatus for an oil refining process.

The second gas-liquid separator 452 may condense the gas separated in the first gas-liquid separator 451, to separate gas from liquid. The separated gas may flow into the third gas-liquid separator 453, and the separated liquid may flow into the atmospheric distillation apparatus for the oil refining process.

The third gas-liquid separator 453 may condense the gas separated in the second gas-liquid separator 452, to separate gas from liquid. The separated liquid may flow into the atmospheric distillation apparatus for the oil refining process.

The hydrocarbon upgrading/separating system 400 may further include a gas separator 460. The gas separator 460 may separate gas from the gas separated in the multi-stage gas-liquid separator 450. The gas separated by the gas separator 460 may be unreacted hydrogen gas. The gas separated by the gas separator 460 may flow into the heating furnace 430, may be mixed with the impurities-containing hydrocarbon and a mixture may be preheated in the heating furnace 430. The preheated mixture may flow into the reactor 440 and may be used in a hydroprocessing reaction. Also, the gas separated by the gas separator 460 may flow directly into the reactor 440 instead of passing through the heating furnace 430. Liquid separated by the gas separator 460 may flow into the atmospheric distillation apparatus.

According to an example embodiment, an example of an oil refining system including a hydrocarbon upgrading/separating system may be provided. By applying the hydrocarbon upgrading/separating system, an energy efficiency and stability of an oil refining process may be enhanced, and a throughput of heavy crude oil may increase.

Figure 6:
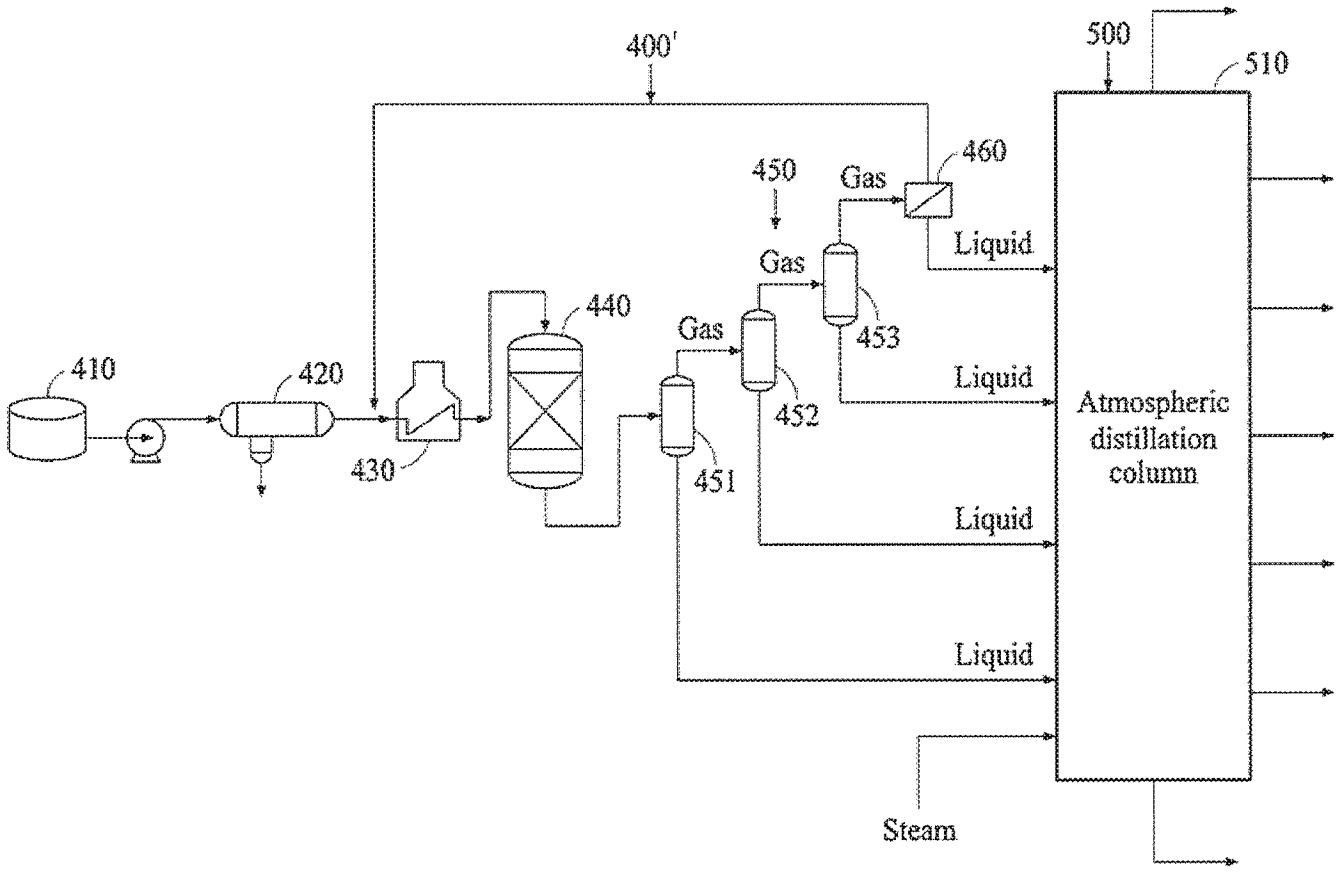
FIG. 6 is a diagram illustrating an example of an oil refining system according to an example embodiment.

FIG. 6 is a diagram illustrating an example of an oil refining system according to an example embodiment. The oil refining system of FIG. 6 may include a hydrocarbon upgrading/separating portion 400', and an atmospheric distillation portion 500.

The hydrocarbon upgrading/separating portion 400' may include a hydrocarbon upgrading/separating system according to an example embodiment. In the hydrocarbon upgrading/separating portion 400', liquid hydrocarbon feeds may be separated in a multi-stage gas-liquid separator 450 and a liquid hydrocarbon feed may also be separated in a gas separator 460.

The atmospheric distillation portion 500 may introduce and distill the liquid hydrocarbon feeds obtained in the hydrocarbon upgrading/separating portion 400' in an atmospheric distillation column 510. The liquid hydrocarbon feeds, together with a steam, may be introduced as side streams into the atmospheric distillation column 510 and may be distilled, to generate a product. The atmospheric distillation column 510 may produce a product using a distillation process applicable in a technical field of the present disclosure, and further description of a process condition is omitted in the present disclosure.

According to an example embodiment, another example of an oil refining system including a hydrocarbon upgrading/separating system may be provided. By applying the hydrocarbon upgrading/separating system, an energy efficiency and stability of an oil refining process may be enhanced. Also, when light crude oil is mixed with liquid hydrocarbon feeds, for example, heavy crude oil, discharged from the hydrocarbon upgrading/separating system, a mixing ratio may increase.

Figure 7:
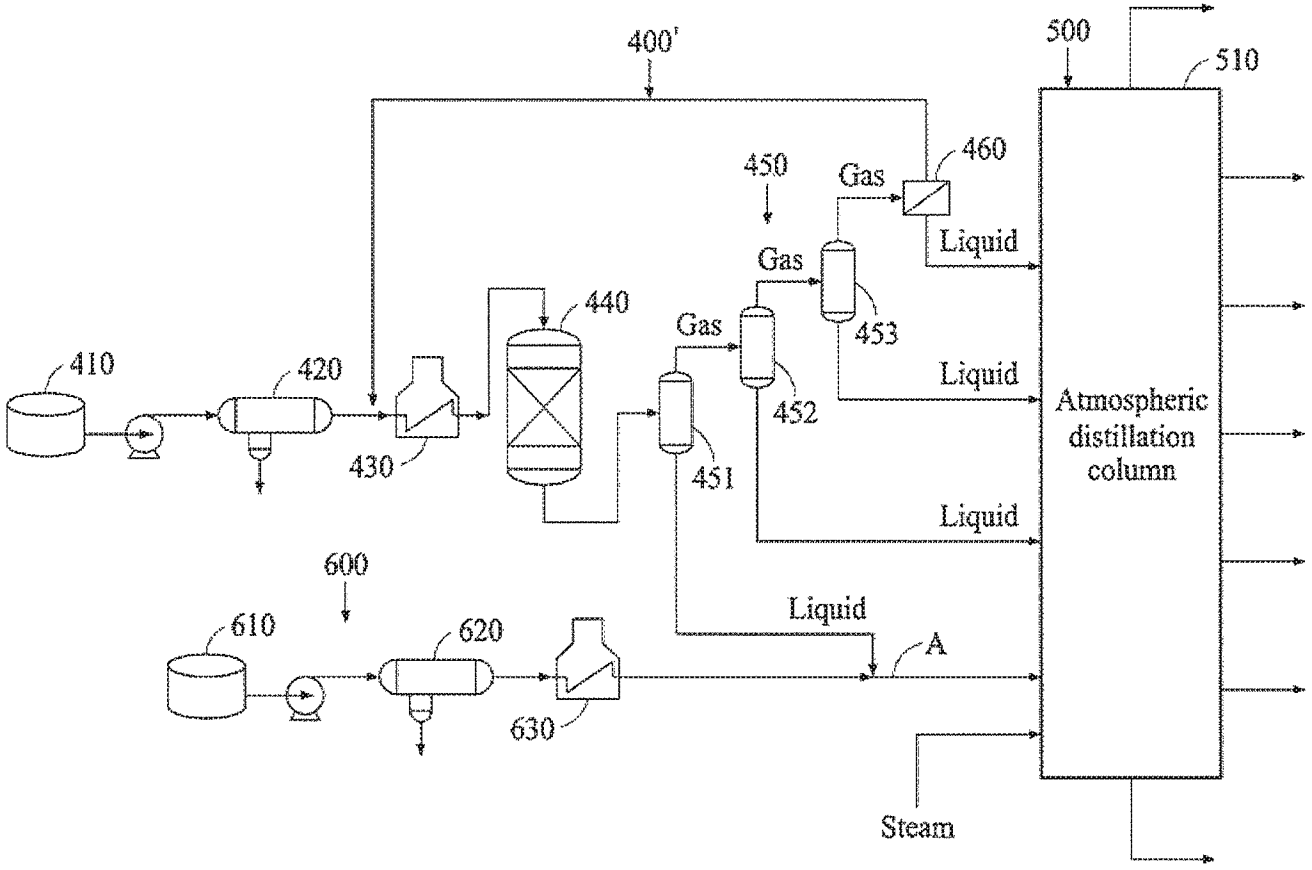
FIG. 7 is a diagram illustrating another example of an oil refining system according to an example embodiment.

FIG. 7 is a diagram illustrating another example of an oil refining system according to an example embodiment. The oil refining system of FIG. 7 may include a hydrocarbon upgrading/separating portion 400', an atmospheric distillation portion 500 and a light crude oil processing portion 600.

The hydrocarbon upgrading/separating portion 400' may include a hydrocarbon upgrading/separating system according to an example embodiment. In the hydrocarbon upgrading/separating portion 400', liquid hydrocarbon feeds may be separated in a multi-stage gas-liquid separator 450 and a liquid hydrocarbon feed may also be separated in a gas separator 460.

The light crude oil processing portion 600 may desalt and preheat light crude oil and may introduce the preheated light crude oil into an atmospheric distillation portion 510. The heavy crude oil processing portion 600 may include a light crude oil storage tank 610, a desalter 620, and a heating furnace 630. For example, the desalter 620 may desalt light crude oil and may discharge the light crude oil to the heating furnace 630. The light crude oil processing portion 600 may further include a dehydrator (not shown) in addition to the desalter 620. The dehydrator may remove moisture from the desalted heavy crude oil.

The atmospheric distillation portion 500 may introduce and distill the liquid hydrocarbon feeds obtained in the hydrocarbon upgrading/separating portion 400' and light crude oil discharged from the light crude oil processing portion 600 in an atmospheric distillation column 510. The liquid hydrocarbon feeds and light crude oil may be mixed in a single supply pipe A, and may be introduced as side streams into the atmospheric distillation column 510. Desirably, light crude oil and a liquid hydrocarbon feed separated by a first gas-liquid separator 451 of the hydrocarbon upgrading/separating portion 400' may be mixed in the single supply pipe A and may be introduced into the atmospheric distillation column 510.

The atmospheric distillation column 510 may produce a product using a distillation process applicable in a technical field of the present disclosure, and further description of a process condition is omitted in the present disclosure.

Hereinafter, the present disclosure will be described with reference to example embodiments, however, is not intended to be limited to the example embodiments. Various modifications and changes may be made in the present disclosure without departing from the spirit and scope of the present disclosure as defined by the appended claims, the detailed description and accompanying drawings.

Example

A catalyst (4.5 wt % CoO, 14.5 wt % $MoO_3/\gamma—Al_2O_3$) and hydrogen gas were inserted into a reactor including heavy crude oil (PI 18.2, TAN 2.0 mg KOH/g), and upgrading was performed for 30 days under a process condition shown in Table 1 below. The catalyst was inserted through a hydrotreatment in a 1 wt % dimethyl disulphide (DMDS)/kerosene solution.

TABLE 1

| Process condition | Temperature (° C.) | Pressure (bar) | LHSV ($h^{-1}$) | $H_2$/Oil (Volume Ratio) | Process Time | Organic acid removal rate (%) |
|---|---|---|---|---|---|---|
| | 300 | 40 | 16 | 60 | 4 hours | 96.23 |
| | 300 | 40 | 16 | 60 | 30 days | 98.27 |

Referring to Table 1, it is found that when hydrocarbon is upgraded, the organic acid removal rate is higher than 96%, a process is stably performed despite a period of 30 days or longer and an excellent organic acid removal rate is provided.

In the present disclosure, it is possible to effectively remove impurities, for example, an organic acid, and the like, from a hydrocarbon oil fraction, for example, heavy crude oil, and the like, and possible to upgrade hydrocarbon by separating hydrocarbon from which impurities are removed into gas and liquid through a process of reducing a pressure and a temperature in at least one stage. Also, unreacted hydrogen gas generated in an upgrading process may be effectively removed, and thus it is possible to increase an energy efficiency and stability of a hydrocarbon oil refining process, to minimize a size of an atmospheric distillation apparatus, to prevent flooding, and the like, and to perform an oil refining process at an economic cost.

According to example embodiments, it is possible to effectively remove impurities, for example, unreacted hydrogen and the like, generated in a reactor in a process of upgrading hydrocarbon to prevent flooding of hydrocarbon in an atmospheric distillation apparatus when the hydrocarbon is introduced into the atmospheric distillation apparatus, and to minimize a size of the atmospheric distillation apparatus.

Also, according to example embodiments, it is possible to effectively remove impurities, for example, an organic acid and the like, in a process of upgrading hydrocarbon, and in particular it is possible to provide an organic acid removal range of 75% or higher.

Furthermore, according to example embodiments, it is possible to enhance a stability of a hydrocarbon oil refining process by separating gas from liquid through a reduction in a pressure in stages.

In addition, according to example embodiments, it is possible to enhance an energy efficiency by introducing separated liquid as a side stream into an atmospheric distillation apparatus.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A method of upgrading and separating hydrocarbon, the method comprising:

preheating hydrocarbon containing impurities;

removing non-hydrocarbon impurities from the hydrocarbon using a hydroprocessing catalyst and hydrogen gas after inserting the preheated hydrocarbon into a reactor; and separating gas from liquid in a multi-stage gas-liquid separator at a temperature of about 40° C. to about 150° C. and a pressure of about 1.2 bar to about 2.5 bar; said multi-stage gas-liquid separator comprising at least:

a first liquid-gas separator which receives output from said reactor and separates said output from said reactor into a first liquid stream and a first gas stream; and a second liquid-gas separator which receives said first gas stream and separates said first gas stream into a second liquid stream and a second gas stream, wherein the step of separating gas from liquid is performed in a continuous process by said multi-stage gas-liquid separator at the same temperature or different temperatures and at the same pressure or different pressures.

2. The method of claim 1, wherein in the removing step, a volume ratio of the hydrocarbon to the hydrogen gas ranges from 1:5 to 1:100.

3. The method of claim 1, wherein the hydroprocessing catalyst comprises:

a support comprising at least one selected from the group consisting of alumina, aluminosilicate, zeolite, silica, titanium oxide and zirconium oxide; and an active catalyst component comprising at least one selected from the group consisting of nickel (Ni), cobalt (Co), tungsten (W), molybdenum (Mo), platinum (Pt), palladium (Pd), ruthenium (Ru), rhodium (Rh), phosphorus (P), carbon (C) and nitrogen (N), or oxides and alloys thereof that is supported on the support.

4. The method of claim 3, wherein the hydroprocessing catalyst comprises at least one selected from the group consisting of CoO, $MoO_3/\gamma—Al_2O_3$; CoO, $WO_3/\gamma—Al_2O_3$; CoO, $MoO_3$/Meso-Y Zeolite; P, CoO, $MoO_3/\gamma—Al_2O_3$; P, CoO, $WO_3/\gamma—Al_2O_3$; NiO, $MoO_3/\gamma—Al_2O_3$; P, NiO, $MoO_3/\gamma—Al_2O_3$; P, NiO, $WO_3/\gamma—Al_2O_3$; P, NiO, $WO_3$, $MoO_3/\gamma—Al_2O_3$; P, CoO, $WO_3$, $MoO_3/\gamma—Al_2O_3$; CoO, $MoO_3/SiO_2—Al_2O_3(SiO_2\text{-}5\%)$; CoO, $MoO_3/SiO_2—Al_2O_3(SiO_2\text{-}20\%)$; CoO, $MoO_3/SiO_2—Al_2O_3(SiO_2\text{-}40\%)$; CoO, $MoO_3/\gamma—Al_2O_3(50\%)$+H-YZ(50%); CoO, $MoO_3$/Nano-MFI(50%)+$\gamma—Al_2O_3(50\%)$; CoO, $MoO_3$/ZeoliteHY (50%)+$\gamma—Al_2O_3(50\%)$; CoO, $MoO_3$/Nano-MFI; P, CoO, $MoO_3/SiO_2—Al_2O_3(SiO_2\text{-}20\%)$; and CoO, $MoO_3$, $P/SiO_2—Al_2O_3(SiO_2\text{-}40\%)$.

5. The method of claim 3, wherein the active catalyst component is present in an amount of 1% by weight (wt %) to 30 wt % in the hydroprocessing catalyst, and the hydroprocessing catalyst is presulfided.

6. The method of claim 1, wherein the removing comprises removing an organic acid.

7. The method of claim 1, wherein the removing step is performed under a condition of a temperature of 250° C. to 400° C., a pressure of 10 bar to 100 bar and a liquid hourly space velocity (LHSV) of 1 $h^{-1}$ to 20 $h^{-1}$.

8. The method of claim 1, wherein the separating step comprises condensing hydrocarbon discharged from the reactor under a condition of a temperature of 40° C. or higher and a pressure of 1.2 bar or higher and separating gas from liquid by at least one multi-stage gas-liquid separator.

9. The method of claim 1, further comprising:

a step of removing hydrogen gas from the separated gas, and wherein the hydrogen gas is reused to remove the non-hydrocarbon impurities.

10. A hydrocarbon oil refining method comprising:

introducing hydrocarbon upgraded and separated by the method of claim 1 into an atmospheric distillation apparatus; and performing an atmospheric distillation.

11. The hydrocarbon oil refining method of claim 10, wherein the step of introducing hydrocarbon comprises introducing the hydrocarbon as a side stream into the atmospheric distillation apparatus.

12. The hydrocarbon oil refining method of claim 10, wherein the step of introducing hydrocarbon comprises introducing a mixture of the hydrocarbon and light crude oil into the atmospheric distillation apparatus.

13. The hydrocarbon oil refining method of claim 12, wherein the light crude oil is desalted and preheated at a temperature of 300° C. to 400° C.

* * * * *